US006262640B1

(12) United States Patent
Tsujiguchi

(10) Patent No.: US 6,262,640 B1
(45) Date of Patent: Jul. 17, 2001

(54) COPLANAR LINE FILTER AND DUPLEXER

(75) Inventor: Tatsuya Tsujiguchi, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/662,196

(22) Filed: Sep. 14, 2000

Related U.S. Application Data

(63) Continuation of application No. 09/241,174, filed on Feb. 1, 1999.

(30) Foreign Application Priority Data

Jan. 30, 1998 (JP) ..... 10-019581

(51) Int. Cl.[7] ..... H01P 1/20; H01P 7/00; H01P 5/12

(52) U.S. Cl. ..... 333/204; 333/202; 333/219; 333/134

(58) Field of Search ..... 333/202, 204, 333/219, 134

(56) References Cited

U.S. PATENT DOCUMENTS 4,233,579 * 11/1980 Carlson et al. ..... 333/204
4,614,925 * 9/1986 Kane ..... 333/174
5,004,992 * 4/1991 Grieco et al. ..... 333/202
5,105,173 * 4/1992 Itou ..... 333/204
5,376,908 * 12/1994 Kawaguchi et al. ..... 333/203
5,612,656 * 3/1997 Sakamoto et al. ..... 333/204

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

The present invention provides a coplanar line filter or a duplexer, comprising: a dielectric substrate; a plurality of λ/4 coplanar resonators provided on said dielectric substrate, said plurality of λ/4 coplanar resonators comprising; a first center conductor having electrical length corresponding to a quarter wavelength; and a ground conductor provided with a gap from said first center conductor; a capacitive coupling portion comprising a gap provided between said first center conductors of a pair of said λ/4 coplanar resonators; and a inductive coupling portion, comprising a guide conductor which electrically connects said first center conductor and ground, provided at a joint portion of a pair of said λ/4 coplanar resonators; said plurality of λ/4 coplanar resonators being connected in series with said capacitive coupling portion and said inductive coupling portion provided alternately. By the above structure and arrangement, a small-scale coplanar line filter or duplexer of simple design is obtained.

8 Claims, 6 Drawing Sheets

COPLANAR LINE FILTER AND DUPLEXER

This is a continuation of application Ser. No. 09/241,174, filed Feb. 1, 1999.

BACKGROUND OF THE INVENTION

1. Field of the Invention

The present invention relates to a coplanar line filter and duplexer, more particularly to a coplanar line filter and duplexer for use in a microwave band communications device and the like.

2. Description of the Related Art

In recent years, a bandpass filter using a coplanar resonator has been proposed as a filter in a microwave band communications device. For instance, FIG. 10 shows a bandpass filter 81 comprising λ/4 coplanar resonators Q11~Q13 are connected in series. The λ/4 coplanar resonators Q11~Q13 are connected between input and output terminals 87 and 88 via capacitors C11~C14, comprising lumped constant elements. The λ/4 coplanar resonator Q11 comprises a center conductor 82*a* and a ground conductor 83, provided while ensuring a gap from the center conductor 82*a*. One end of the center conductor 82*a* is electrically connected to the ground conductor 83, forming a λ/4 coplanar resonator Q11 with one connected end. Similarly, the λ/4 coplanar resonators Q12 and Q13 comprise center conductors 82*b* and 82*c*, having electrical length corresponding to a quarter wavelength, and the ground conductor 83, provided while ensuring a gap from these center conductors 82*b* and 82*c*.

Furthermore, the bandpass filter 91 shown in FIG. 11 comprises λ/2 coplanar resonators Q14~Q16 connected in series. The λ/4 coplanar resonator Q14 comprises a center conductor 92*a*, having electrical length corresponding to a half wavelength, and ground conductors 93, provided on either side of the center conductor 92*a* while ensuring a gap between the center conductor 92*a* and the ground conductors 93. Similarly, the λ/2 coplanar resonators Q15 and Q16 each comprise center-conductors 92*b* and 92*c*, having electrical lengths corresponding to a half wavelength, and the ground conductors 93, on either side of the center conductors 92*b* and 92*c* while ensuring a gap between these and the ground conductors 93. The λ/2 coplanar resonators Q14~Q16 are connected in series by capacitive couplers C16 and C17, formed at a gap provided between center conductors 92*a* and 92*b* and a gap provided between center conductors 92*b* and 92*c*, and are connected between input/output terminals 97 and 98 by capacitive couplers C15 and C18, formed at a gap provided between the center conductor of the input/output terminal 97 and the center conductor 92*a* of the resonator Q14, and a gap provided between the center conductor of the input/output terminal 98 and the center conductor of the resonator Q16.

However, in the bandpass filter 81 shown in FIG. 10, since the center conductors 82*a*~82*c* of the λ/4 coplanar resonators Q11~Q13 are mutually separated by the ground conductor 83, it is difficult to connect the λ/4 coplanar resonators Q11~Q13 with a distribution-constant device, and design was complex. On the other hand, since the bandpass filter 91 shown in FIG. 11, uses center conductors 92*a*~92*c* having electrical lengths corresponding to a half wavelength, it is large-scale by comparison with a bandpass filter which used λ/4 coplanar resonators.

SUMMARY OF THE INVENTION

To overcome the above described problems, preferred embodiments of the present invention provide an easily-designed small-scale coplanar line filter and duplexer.

One preferred embodiment of the present invention provides a coplanar line filter or a duplexer, comprising: a dielectric substrate; a plurality of λ/4 coplanar resonators provided on said dielectric substrate, said plurality of λ/4 coplanar resonators comprising; a first center conductor having electrical length corresponding to a quarter wavelength; and a ground conductor provided with a gap from said first center conductor; a capacitive coupling portion comprising a gap provided between said first center conductors of a pair of said λ/4 coplanar resonators; and a inductive coupling portion, comprising a guide conductor which electrically connects said first center conductor and ground, provided at a joint portion of a pair of said λ/4 coplanar resonators: said plurality of λ/4 coplanar resonators being connected in series with said capacitive coupling portion and said inductive coupling portion provided alternately.

By the above described structure and arrangement, a coplanar line filter or a duplexer can be made small-scale by using coplanar resonators comprising a center conductor having electrical length corresponding to a quarter wavelength. Capacitive couplers, using capacitance in a gap provided between center conductors of multiple λ/4 coplanar resonators, and dielectric couplers, using inductance of guide conductors electrically connecting center conductors and ground conductors, are alternately repeated and connected in series. With this arrangement, the capacitive coupling is strengthened when the capacitance of the gap between center conductors is stronger, and the inductive coupling is strengthened when the inductance of the guide conductors, electrically connecting the center conductors and ground conductors, is stronger. Therefore, the bandwidth of the filter or the duplexer is set by adjusting the strength and weakness of these distribution-constant capacitive couplers and dielectric couplers.

The above described coplanar line filter or duplexer may further comprise input/output terminal portions provided on said dielectric substrate, said input/output terminal portions comprising a second center conductor and a ground conductor provided with a gap therebetween, and the second center conductors of said input/output terminal portions being electrically connected to the first center conductors of said λ/4 coplanar resonators.

By the above described structure and arrangement, the input/output terminal portion is provided on the same flat surface of the dielectric substrate as the coplanar resonators. With this arrangement, coupling of the coplanar line filter via this input/output terminal portion to an external circuit is stronger than a coupling of a coplanar line filter to an external circuit via a conventional capacitor component. This is also the same in the case of a duplexer.

Furthermore, in the above described coplanar line filter or duplexer, the first center conductors of the λ/4 coplanar resonators may be provided in a zigzag shape to thereby reduce the length of the coplanar line filter or duplexer. In addition, since the distance between the λ/4 coplanar resonators is reduced, it is possible to connect the resonators in series and electromagnetically join them to form a bias circuit.

Other features and advantages of the present invention will become apparent from the following description of embodiments of the invention which refers to the accompanying drawings.

DESCRIPTION OF THE PREFERRED EMBODIMENTS

Figure 1:
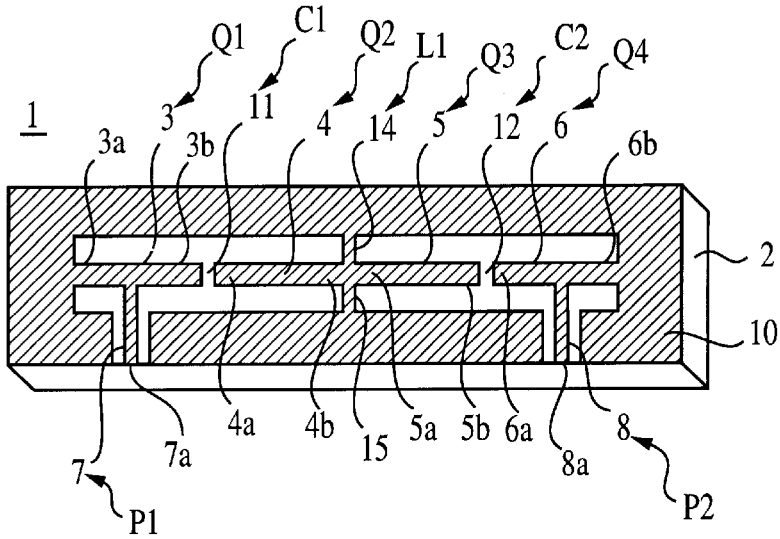
FIG. 1 is a perspective view of a first preferred embodiment of a coplanar line filter according to the present invention.

[First Preferred Embodiment, FIG. 1]

As shown in FIG. 1, a coplanar line filter 1 comprises a dielectric substrate 2, four coplanar resonators Q1, Q2, Q3 and Q4, provided on the top surface of this dielectric substrate 2, capacitive coupling portions C1 and C2, a inductive coupling portion L1, and input/output terminal portions P1 and P2.

The λ/4 coplanar resonator Q1 comprises a linear-shaped first center conductor 3, which has an electrical length corresponding to a quarter wavelength of the resonant frequency, and a ground conductor 10, provided so as to at least partially surround the center conductor 3 with a gap from the first center conductor 3. Similarly, the λ/4 coplanar resonators Q2, Q3 and Q4 comprise linear-shaped first center conductors 4, 5 and 6, which have electrical lengths corresponding to a quarter wavelength of the resonant frequency, and the ground conductor 10, provided so as to at least partially surround the center conductors 4, 5 and 6 with a gap from the center conductors 4, 5 and 6.

End portions 3*a* and 6*b* of the first center conductors 3 and 6 of λ/4 coplanar resonators Q1 and Q4 are electrically connected to the ground conductor 10, forming a comb-line resonator with one grounded end. The λ/4 coplanar resonators Q1 and Q2 are capacitance-coupled via a capacitive coupling portion C1, comprising a gap 11 provided between the end 3*b* of the first center conductor 3 and the end 4*a* of the first center conductor 4. Similarly, the λ/4 coplanar resonators Q3 and Q4 are capacitance-coupled via a capacitive coupling portion C2, comprising a gap 12 provided between the end 5*b* of the first center conductor 5 and the end 6*a* of the first center conductor 6.

On the other hand, the λ/4 coplanar resonators Q2 and Q3 are dielectrically coupled via an inductive coupling portion L1, comprising linear-shaped guide conductors 14 and 15, provided at the joint portion between the end 4*b* of the first center conductor 4 and the end 5*a* of the first center conductor 5. The guide conductors 14 and 15 run at a right angle to the first center conductors 4 and 5 to opposing positions on either side of the first center conductors 4 and 5, electrically connecting the first center conductors 4 and 5 and the ground conductor 10. Thus, the λ/4 coplanar resonators Q1~Q4 are connected in series by alternately repeating a capacitive coupling, by capacitance generated in the gaps 11 and 12 of the capacitive coupling portions C1 and C2, and inductive coupling, by inductance of guide conductors 14 and 15 of the inductive coupling portion L1.

Furthermore, the input/output terminal portion P1 comprises a linear-shaped second center conductor 7 and a ground conductor 10 provided so as to at least partially surround the second center conductor 7 and with a gap from the second center conductor 7. This input/output terminal portion P1 is provided at a position to the left of the dielectric substrate 2, the second center conductor 7 being connected substantially at a right angle to the first center conductor 3 of the λ/4 coplanar resonator Q1. The open end 7*a* of the second center conductor 7 is exposed near the edge of the dielectric substrate 2. Similarly, the input/output terminal portion P2 comprises a linear-shaped second center conductor 8 and the ground conductor 10 provided so as to at least partially surround the second center conductor 8 with a gap from the center conductor 8. This input/output terminal portion P2 is provided at a position to the right of the dielectric substrate 2, the second center conductor 8 being connected substantially at a right angle to the first center conductor 6 of the λ/4 coplanar resonator Q4. The open end 8*a* of the second center conductor 8 is exposed near the edge of the dielectric substrate 2.

Resin, such as epoxy or polymide, or a ceramic dielectric or the like, is used as material for the dielectric substrate 2. The conductors 3~8, 10, 14 and 15 are formed by a method such as the sputtering method, vacuum evaporation method, plating method, printing method or using material such as Ag—Pd, Ag, Pd, or Cu.

The coplanar line filter 1 of the above structure and arrangement functions as a bandpass filter, and the capacitive coupling portion is strengthened when the capacitance of the capacitive coupling portions C1 and C2 is greater, and the inductive coupling is strengthened when the inductance of the inductive coupling portion L1 is great. Therefore, by adjusting the strength and weakness of these distribution-constant capacitive couplers and dielectric couplers, the bandwidth of the filter 1 can be set easily. In addition, since the length of the center conductors 3~6 of the coplanar resonators Q1~Q4 is a quarter wavelength, which is short, it is possible to achieve a small-scale filter 1.

Figure 2:
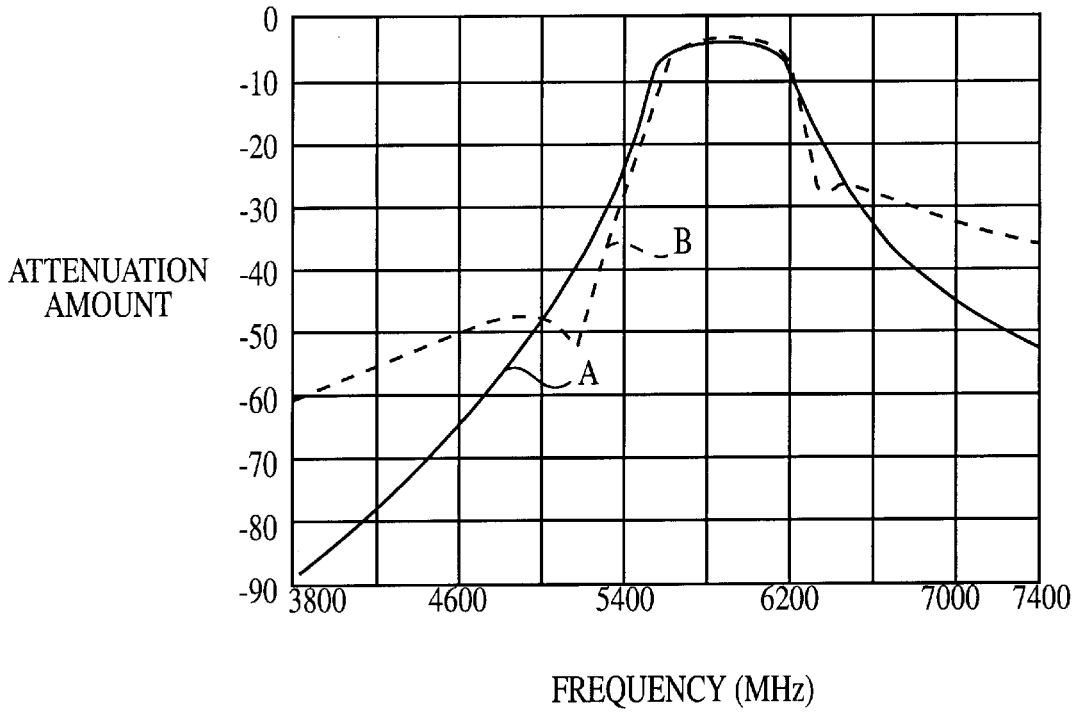
FIG. 2 is a graph showing attenuation characteristics of the coplanar line filter shown in FIG. 1.

Furthermore, the coupling of the filter 1 via the input/output terminal portion P1 to an external circuit is stronger when the connection position of the second center conductor 7 of the input/output terminal portion P1 and the first center conductor 3 of the resonator Q1 is closer to the open end 3*b* of the resonator Q1. Similarly, the coupling of the filter 1 via the input/output terminal portion P2 to an external circuit is stronger when the connection position of the second center conductor 8 of the input/output terminal portion P2 and the first center conductor 6 of the resonator Q4 is closer to the open end 6*b* of the resonator Q4. Thus, the input/output terminal portions P1 and P2 can be provided together with the coplanar resonators Q1~Q4 on the top surface of the dielectric substrate 2, and the filter 1 can be made low-profile. Furthermore, the coupling of the filter 1 via the input/output terminal portions P1 and P2 to an external circuit can be made stronger in comparison with a coupling via a conventional capacitor component. The solid line A of FIG. 2 is a graph illustrating attenuation characteristics of a coplanar filter obtained in this way.

Figure 3:
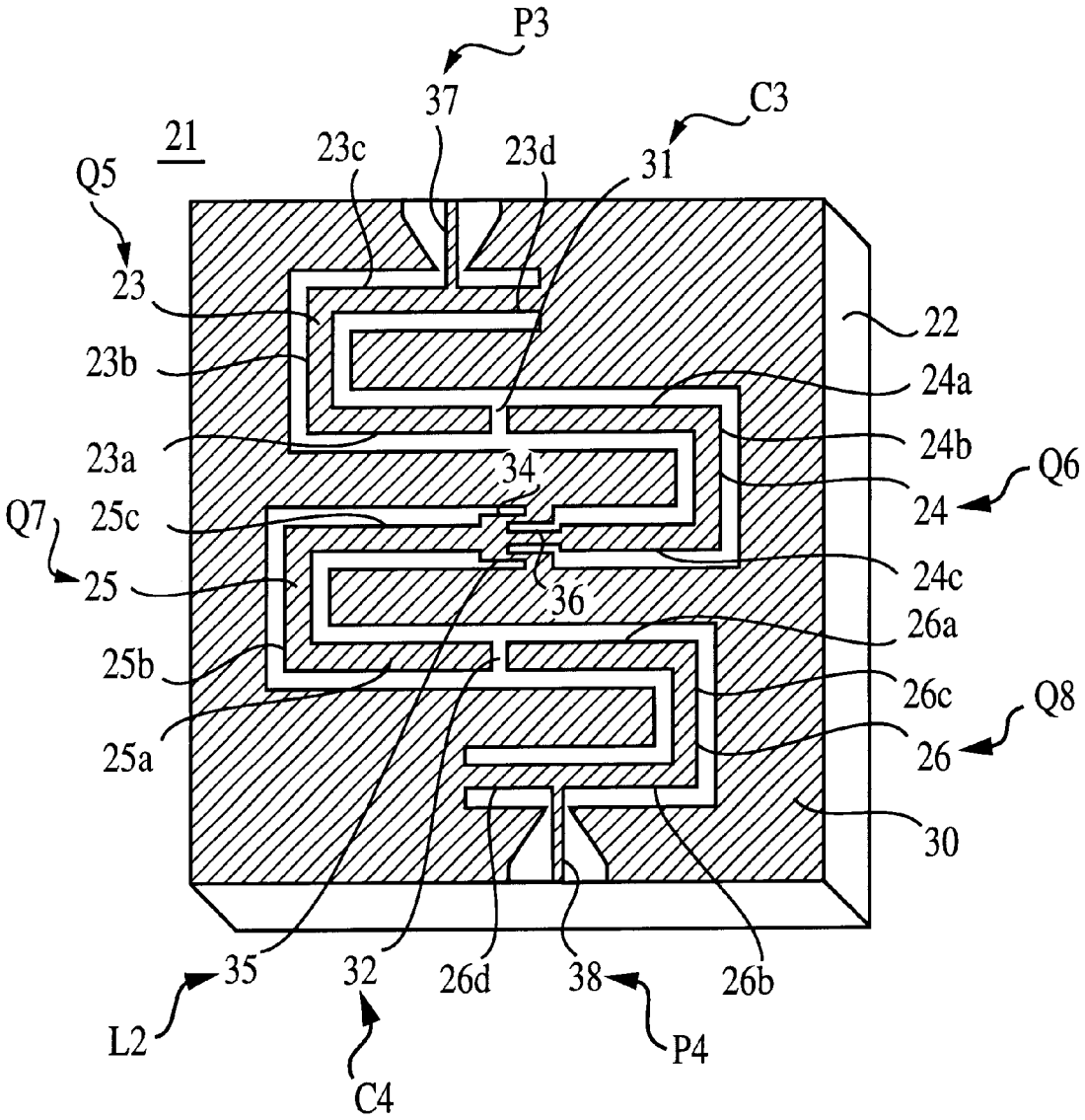
FIG. 3 is a perspective view of a second preferred embodiment of a coplanar line filter according to the present invention.
Figure 4:
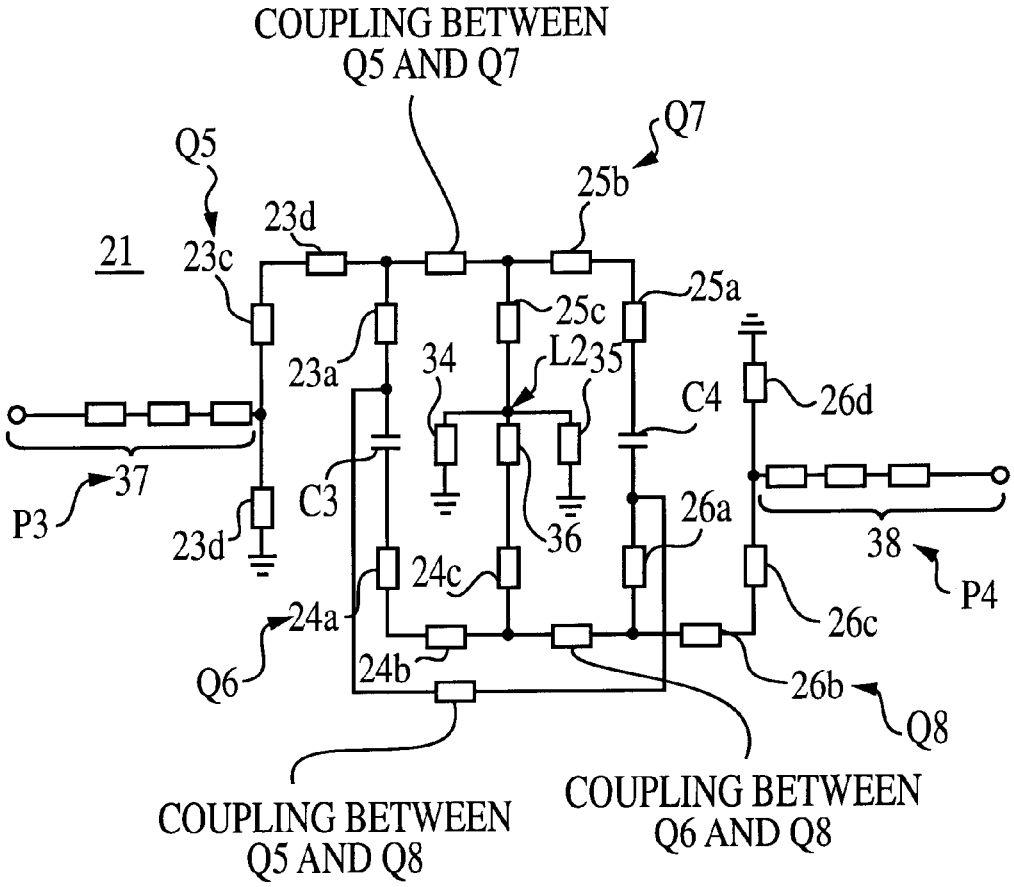
FIG. 4 is an electrical equivalent circuit of the coplanar line filter shown in FIG. 3.

[Second Preferred Embodiment, FIG. 3 and FIG. 4]

As shown in FIG. 3, a coplanar line filter 21 comprises a dielectric substrate 22, four λ/4 coplanar resonators Q5, Q6, Q7 and Q8 provided on the top surface of this dielectric substrate 22, capacitive coupling portions C3 and C4, an inductive coupling portion L2, an input terminal portion P3 and an output terminal portion P4.

The λ/4 coplanar resonator Q5 comprises a U-shaped first center conductor 23, which has an electrical length corresponding to a quarter wavelength of the resonant frequency, and a ground conductor 30, provided so as to at least partially surround the center conductor 23 with a gap from the center conductor 23. Similarly, the λ/4 coplanar resonators Q6, Q7 and Q8 comprise U-shaped first center conductors 24, 25 and 26, which have electrical lengths corresponding to a quarter wavelength of the resonant frequency, and the ground conductor 30, provided so as to at least partially surround the center conductors 24, 25 and 26 with a gap from the center conductors 24, 25 and 26. The coplanar resonators Q5~Q8 are provided in a zigzag shape.

One end portion of each of the first center conductors 23 and 26 of λ/4 coplanar resonators Q5 and Q8 is electrically connected to the ground conductor 30, forming a comb-line resonator with one grounded end. The λ/4 coplanar resonators Q5 and Q6 are capacitively coupled by a capacitive coupling portion C3, which is formed at a gap 31 provided between the other end portion of the first center conductor 23 and other end portion of the first center conductor 24. Similarly, λ/4 coplanar resonators Q7 and Q8 are capacitively coupled by the capacitive coupling portion C4, which is formed at a gap 32 provided between an end portion of the first center conductor 25 and an portion of the first center conductor 26.

On the other hand, the λ/4 coplanar resonators Q6 and Q7 are dielectrically coupled via the inductive coupling portion L2, comprising curve-shaped guide conductors 34 and 35, and also a linear-shaped guide conductor 36, which has thinner guide width than the first center conductors 24 and 25, provided at a joint portion between an end portion of the center conductor 24 and an end portion of the first center conductor 25. The guide conductors 34 and 35 electrically connect between the center conductors 24 and 25 and the ground conductor 30. In addition, the resonators Q5 and Q7 are adjacent, and are electromagnetically coupled. The resonators Q6 and Q8 are also adjacent, and are electromagnetically coupled. The resonators Q5 and Q8 are electromagnetically coupled via the ground conductor 30.

Thus, the λ/4 coplanar resonators Q5~Q8 are connected in series by alternately repeating a capacitive coupling, by capacitance generated in the gaps 31 and 32 of the capacitive coupling portions C3 and C4, and a inductive coupling, using inductance of guide conductors 34~36 of the inductive coupling portion L1, and in addition, resonators Q5 and Q7, Q6 and Q8, Q5 and Q8 are electromagnetically connected, forming a bias circuit (see FIG. 4).

Furthermore, the input terminal portion P3 comprises a linear-shaped second center conductor 37 and a ground conductor 30 provided so as to at least partially surround the second center conductor 37 with a gap from the center conductor 37. This input terminal portion P1 is provided in a topside center portion of the dielectric substrate 22, the second center conductor 37 being connected substantially at a right angle to the first center conductor 23 of the λ/4 coplanar resonator Q5. Similarly, the output terminal portion P4 comprises a linear-shaped second center conductor 38 and a ground conductor 30 provided so as to at least partially surround the second center conductor 38 with a gap from the center conductor 38. This input/output terminal portion P4 is provided in a bottom side center portion of the dielectric substrate 22, the second center conductor 38 being connected substantially at a right angle to the first center conductor 26 of the λ/4 coplanar resonator Q8.

FIG. 4 is an electrical equivalent circuit of a coplanar line filter 21 of the above structure and arrangement. In FIG. 4, the first center conductors 23 and 26 of the resonators Q5 and Q8 are each depicted as split into four guide portions 23*a*~23*d* and 26*a*~26*d* (see FIG. 1). Similarly, the first center conductors 24 and 25 of the resonators Q6 and Q7 are each depicted as split into four guide portions 24*a*~24*d* and 25*a*~25*d*.

This filter 21 achieves similar operation effect as the filter 1 of the first preferred embodiment, and in addition, since the first center conductors 23~26 of the coplanar resonators Q5~Q8 are provided in a zigzag shape, the length of the filter 21 can be made short. Moreover, a bias circuit can be formed by electromagnetically connecting the resonators Q5 and Q7, Q6 and Q8, Q5 and Q8. Consequently, attenuation poles can be generated in the attenuation characteristics of the filter 21 near the lower frequency side and near the high frequency side of the pass band, whereby steeper attenuation characteristics can be obtained (see dotted line B of FIG. 2).

Figure 5:
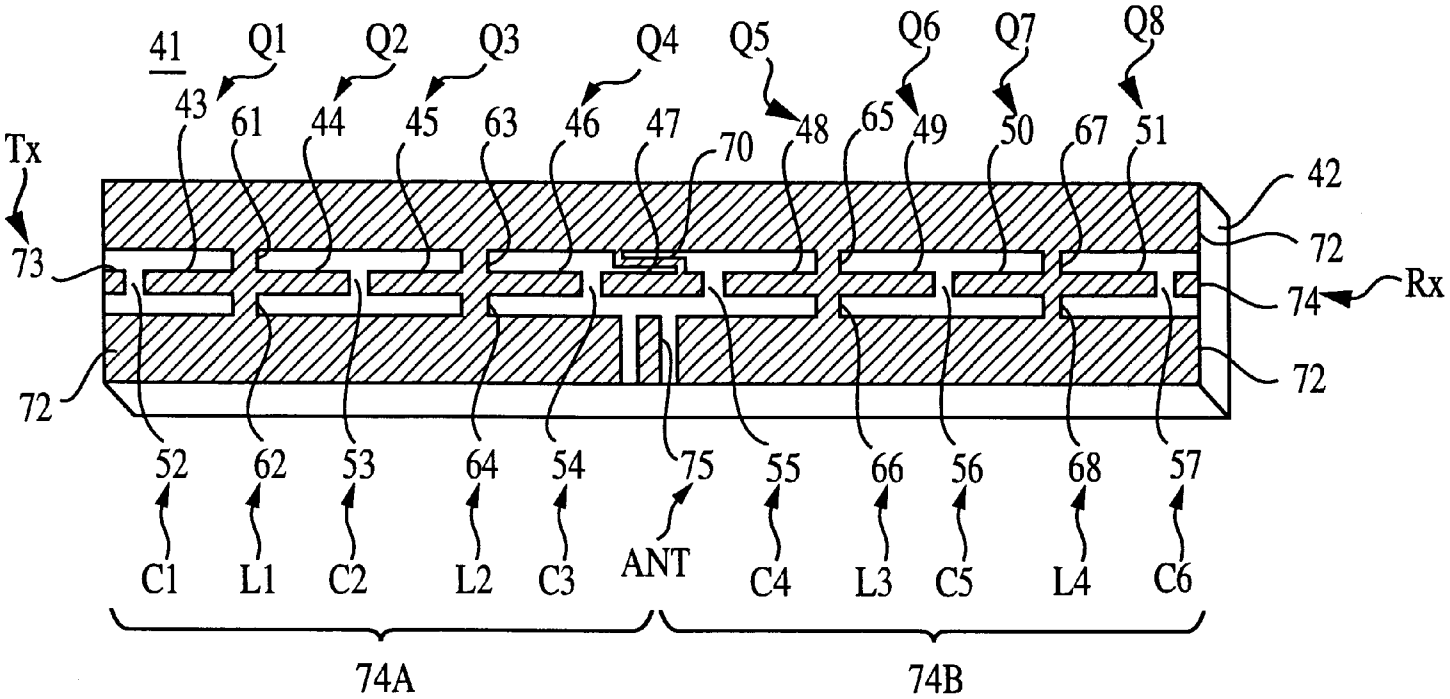
FIG. 5 is a perspective view of a duplexer according to an embodiment of the present invention.

[Third Preferred Embodiment, FIG. 5]

The third preferred embodiment explains a duplexer for use in a mobile communications device such as a vehicle telephone and a cellular telephone. As shown in FIG. 5, a duplexer 41 comprises a dielectric substrate 42, eight λ/4 coplanar resonators Q1~Q8, provided on the top surface of this dielectric substrate 42, capacitive coupling portions C1~C6, inductive coupling portions L1~L4, a transmission side terminal portion Tx, a reception side terminal portion Rx, and an antenna terminal portion ANT.

The λ/4 coplanar resonators Q1~Q8 comprise linear-shaped first center conductors 43~51 having electrical length corresponding to a quarter wavelength of the resonant frequency, and a ground conductor 72, provided so as to at least partially surround the first center conductors 43~51 in between. However, in order to make the duplexer 41 more small-scale, the first center conductors 43~51 may of course be made U-shaped and provided in a zigzag shape. The λ/4 coplanar resonators Q4 and Q5 are coupled via a linear-shaped first center conductor 47 having an electrical length corresponding to a quarter wavelength. However, the length of the first center conductor 47 is not restricted to a quarter wavelength. A curved-shaped guide conductor 70 extends to a ground conductor for adjustment 72 and is connected to the first center conductor 47.

The λ/4 coplanar resonators Q2 and Q3 are capacitively coupled by a capacitive coupling portion C2, comprising a gap 53 provided between end portions of the first center conductors 44 and 45, and the λ/4 coplanar resonator Q4 and the first center conductor 47 are capacitively coupled by a capacitive coupling portion C3, comprising a gap 54 provided between end portions of the first center conductors 46 and 47. The λ/4 coplanar resonators Q1 and Q2 are dielectrically coupled by an inductive coupling portion L1, comprising guide conductors 61 and 62, which are provided at a joint portion between the first center conductors 43 and 44, and the λ/4 coplanar resonators Q3 and Q4 are dielectrically coupled by a inductive coupling portion L2, comprising guide conductors 63 and 64, which are provided at a joint portion between the center first conductors 45 and 46. As a result, the λ/4 coplanar resonators Q1~Q4 are connected in series by alternately repeating the inductive coupling portions L1 and L2 and the capacitive coupling portion C2, thereby forming a transmission filter 74A comprising a bandpass filter.

On the other hand, the λ/4 coplanar resonator Q5 and the first center conductor 47 are capacitively coupled by a capacitive coupling portion C4 comprising a gap 55 provided between end portions of the first center conductors 47 and 48, and the λ/4 coplanar resonators Q6 and Q7 are capacitively coupled by a capacitive coupling portion C5, comprising a gap 56 provided between end portions of the first center conductors 49 and 50. The λ/4 coplanar resonators Q5 and Q6 are dielectrically coupled by an inductive coupling portion L3, comprising guide conductors 65 and 66, which are provided at a joint portion between the first center conductors 48 and 49, and the λ/4 coplanar resonators Q7 and Q8 are dielectrically coupled by an inductive coupling portion L4, comprising guide conductors 67 and 68, which are provided at a joint portion between the first center conductors 50 and 51. As a result, the λ/4 coplanar resonators Q5~Q8 are connected in series with the capacitive coupling portion C2 and the inductive coupling portions L3 and L4 alternately repeated, thereby forming a receive filter 74B comprising a bandpass filter.

Furthermore, the transmission side terminal portion Tx comprises a first center conductor 73, and a ground conductor 72, provided so as to at least partially surround this first center conductor 73. The transmission side terminal portion Tx and the λ/4 coplanar resonator Q1 are electrically connected via the capacitive coupling portion C1, comprising the gap 52 provided between end portions of the first center conductors 73 and 43. Similarly, the reception side terminal portion Rx comprises a first center conductor 74, and a ground conductor 72, provided so as to at least partially surround this first center conductor 74. The reception side terminal portion Rx and the λ/4 coplanar resonator Q8 are electrically connected via the capacitive coupling portion C6, comprising the gap 57 provided between end portions of the first center conductors 74 and 51. Furthermore, the antenna terminal portion ANT comprises a first center conductor 75 and a ground 72, provided so as to clasp this first center conductor 75. The first center conductor 75 of this antenna terminal portion ANT connects substantially at a right angle to the first center conductor 47.

The duplexer 41 of the above described structure and arrangement comprises the transmission filter 74A, comprising the λ/4 coplanar resonators Q1~Q4, and the receive filter 74B, comprising the λ/4 coplanar resonators Q5~Q8. The duplexer 41 outputs a transmission signal, which has entered the transmission side terminal portion Tx from a transmission circuit system not shown in the diagram, via the transmission filter 74A to the antenna terminal portion ANT, and in addition, outputs a receive signal, which enters the antenna terminal portion ANT, from the reception side terminal portion Rx via the receive filter 74B to a receive circuit system not shown in the diagram. In this manner, since the duplexer 41 comprising the λ/4 coplanar resonators Q1~Q8 is provided on a dielectric substrate 42, it is possible to make the duplexer 41 low-profile and small-scale.

[Other Preferred Embodiments]

The coplanar line filter and duplexer according to the present invention are not limited to the preferred embodiments described above, and various alterations can be made thereto within the spirit and scope thereof.

Figure 6:
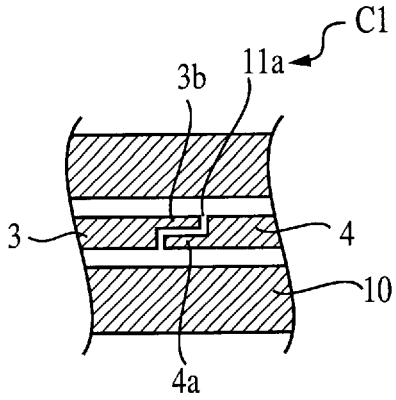
FIG. 6 is a partial plan view of a modification of a capacitive coupling portion.
Figure 7:
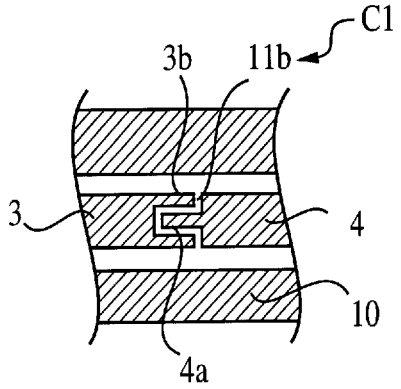
FIG. 7 is a partial plan view of another modification of a capacitive coupling portion.
Figure 8:
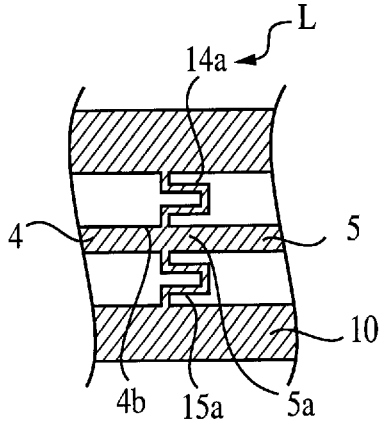
FIG. 8 is a partial plan view of a modification of an inductive coupling portion.

For instance, in the coplanar line filter of the first preferred embodiment, as shown in FIG. 6 and FIG. 7, in order to strengthen the coupling of the capacitive coupling portion C1, gaps 11*a* and 11*b* of wide opposing area can be provided. Furthermore, as shown in FIG. 8, in order to strengthen the coupling of the inductive coupling portion L1, guide conductors 14*a* and 15*a* of long guide length may be provided in a zigzag shape.

Figure 9:
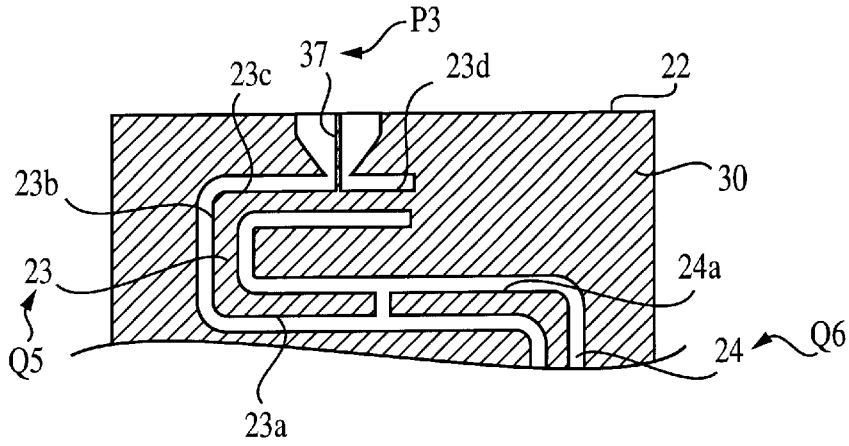
FIG. 9 is a partial plan view of a zigzag modification of a first center conductor of a coplanar resonator.
Figure 10:
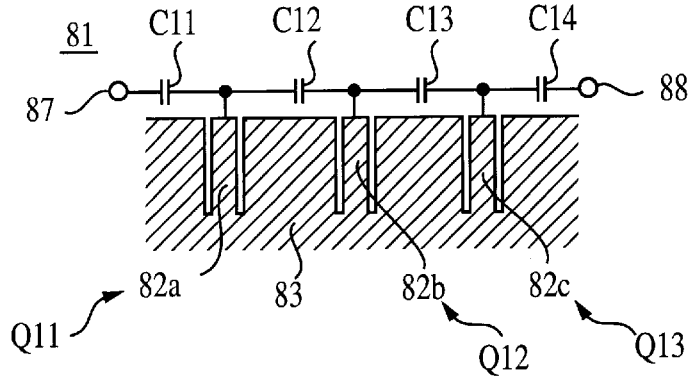
FIG. 10 PRIOR ART
FIG. 10 is an electrical circuit diagram showing a conventional coplanar line filter.
Figure 11:
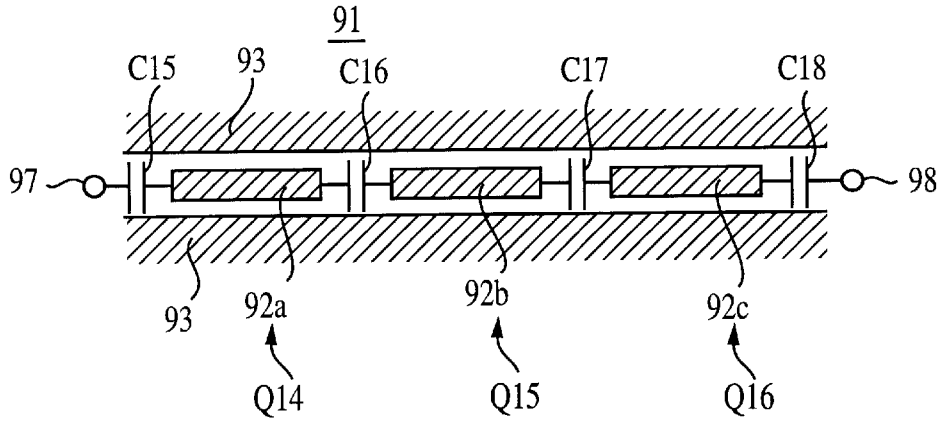
FIG. 11 PRIOR ART
FIG. 11 is an electrical circuit diagram showing another conventional coplanar line filter.

Moreover, in the coplanar line filter 21 of the second preferred embodiment, as shown in FIG. 9, the corners of the first center conductors 23 and 24 and the like may be rounded. Or, a ground conductor may be provided on the bottom surface opposing the top surface of the dielectric substrate, which the coplanar resonator is provided on, thereby forming what is known as a grounded coplanar line filter and duplexer.

As is clear from the explanation above, according to the present invention, multiple λ/4 coplanar resonators are connected in series by alternately providing capacitive coupling portions and inductive coupling portions, and consequently it is possible to obtain a small-scale coplanar line filter and duplexer of easy design. Furthermore, by providing input/output terminal portions, comprising a center conductor and a ground conductor provided at a predetermined interval from the center conductor, on a dielectric substrate, a coupling of an external circuit and a filter or an external circuit and a duplexer can be made stronger than a conventional coupling. Furthermore, by providing center conductors of multiple λ/4 coplanar resonators in a zigzag shape, the length of the filter or duplexer can be shortened. Moreover, since the distance between resonators is reduced, resonators connected in series can be electromagnetically coupled, forming a bias circuit. As a consequence of this, for instance, attenuation characteristics of the filter can be made steep.

While the invention has been particularly shown and described with reference to preferred embodiments thereof, it will be understood by those skilled in the art that the foregoing and other changes in form and details may be made therein without departing from the spirit of the invention.

What is claimed is:

1. A coplanar line filter, comprising:

a dielectric substrate comprising a substantially flat surface;

a plurality of λ/4 coplanar resonators provided on said flat surface of said dielectric substrate, each of said plurality of λ/4 coplanar resonators comprising:

a first center conductor having electrical length corresponding to a quarter wavelength; and a ground conductor provided on opposite sides of said first center conductor which is spaced on said sides by substantially the same gaps from said first center conductor and substantially parallel thereto;

a capacitive coupling portion comprising a gap provided between respective ends of said first center conductors of a pair of said λ/4 coplanar resonators; and an inductive coupling portion, comprising a guide conductor which electrically connects said first center conductor and ground, provided at a joint portion of a pair of said λ/4 coplanar resonators;

said plurality of λ/4 coplanar resonators being connected in series with said capacitive coupling portion and said inductive coupling portion provided alternately;

wherein said respective ends of the first center conductors, which form the capacitive coupling portion, have substantially the same width.

2. The coplanar line filter according to claim 1, further comprising:

input/output terminal portions provided on said flat surface of said dielectric substrate, said input/output terminal portions comprising a second center conductor and a ground conductor provided with a gap therebetween, and the second center conductors of said input/output terminal portions being electrically connected to the first center conductors of said λ/4 coplanar resonators.

3. The coplanar line filter according to claim 1, wherein the first center conductors of said λ/4 coplanar resonators are provided in a non-straight shape.

4. A duplexer comprising:

a pair of filters, each filter having respective first and second terminals, the respective first terminals of the pair of filters being connected together and connected to a common terminal which is usable for connection to an antenna, the respective second terminals of the pair of terminals being usable for connection respectively to a transmitter and to a receiver;

at least one of said filters being a coplanar line filter, comprising:

a dielectric substrate comprising a substantially flat surface;

a plurality of λ/4 coplanar resonators provided on said flat surface of said dielectric substrate, each of said plurality of λ/4 coplanar resonators comprising:

a first center conductor having electrical length corresponding to a quarter wavelength; and a ground conductor provided on opposite sides of said first center conductor which is spaced on said sides by substantially the same gaps from said first center conductor and substantially parallel thereto;

a capacitive coupling portion comprising a gap provided between respective ends of said first center conductors of a pair of said λ/4 coplanar resonators; and an inductive coupling portion, comprising a guide conductor which electrically connects said first center conductor and ground, provided at a joint portion of a pair of said λ/4 coplanar resonators;

said plurality of λ/4 coplanar resonators being connected in series with said capacitive coupling portion and said inductive coupling portion provided alternately;

wherein in each said filter, said respective ends of the first center conductors, which form the capacitive coupling portion, have substantially the same width.

5. The duplexer according to claim 4, further comprising:

input/output terminal portions provided on said flat surface of dielectric substrate, said input/output terminal portions comprising a second center conductor and a ground conductor provided with a gap therebetween, and the second center conductors of said input/output terminal portions being electrically connected to the first center conductors of said λ/4 coplanar resonators.

6. The duplexer according to claim 4, wherein the first center conductors of said λ/4 coplanar resonators are provided in a non-straight shape.

7. The coplanar line filter according to claim 1, wherein said first center conductors of the λ/4 coplanar resonators have substantially uniform width through the entire length thereof.

8. The duplexer according to claim 4, wherein in each said filter, said first center conductors of the λ/4 coplanar resonators have substantially uniform width through the entire length thereof.

* * * * *